US008854163B2

(12) United States Patent
Gessner et al.

(10) Patent No.: US 8,854,163 B2
(45) Date of Patent: Oct. 7, 2014

(54) OPERATING ELEMENT HAVING TWO SWITCHING OR CONTROL STAGES

(75) Inventors: Volker Gessner, Salz (DE); Thilo Schultheis, Salz (DE); Arthur Klossek, Salz (DE)

(73) Assignee: Preh GmbH (DE)

( * ) Notice: Subject to any disclaimer, the term of this patent is extended or adjusted under 35 U.S.C. 154(b) by 0 days.

(21) Appl. No.: 13/702,441

(22) PCT Filed: Jun. 3, 2011

(86) PCT No.: PCT/EP2011/059211

§ 371 (c)(1),
(2), (4) Date: Mar. 1, 2013

(87) PCT Pub. No.: WO2011/154322

PCT Pub. Date: Dec. 15, 2011

(65) Prior Publication Data

US 2013/0271245 A1 Oct. 17, 2013

(30) Foreign Application Priority Data

Jun. 8, 2010 (DE) ..... 10 2010 029 817

(51) Int. Cl.
*H01H 9/00* (2006.01)
*H01H 36/00* (2006.01)
*G05G 1/02* (2006.01)

(52) U.S. Cl.
CPC ..... *H01H 36/0073* (2013.01); *G05G 1/02* (2013.01)
USPC ..... 335/207; 335/205

(58) Field of Classification Search
USPC ..... 335/220, 229
See application file for complete search history.

(56) References Cited

U.S. PATENT DOCUMENTS

| | | | | |
|---|---|---|---|---|
| 6,246,307 | B1 * | 6/2001 | Friedman | 335/205 |
| 7,619,499 | B2 * | 11/2009 | Wieler et al. | 335/285 |
| 7,765,032 | B2 * | 7/2010 | Huston et al. | 700/258 |
| 8,256,098 | B2 * | 9/2012 | Michael | 335/285 |
| 8,350,663 | B1 * | 1/2013 | Michael | 338/288 |
| 2011/0068885 | A1 * | 3/2011 | Fullerton et al. | 335/306 |

FOREIGN PATENT DOCUMENTS

| | | |
|---|---|---|
| EP | 1615250 | 1/2006 |
| FR | 2909741 | 6/2008 |
| WO | 2007009744 | 1/2007 |
| WO | 2009089874 | 7/2009 |

OTHER PUBLICATIONS

ISR PCTEP2011059211 dtd Oct. 7, 2011.

* cited by examiner

*Primary Examiner* — Bernard Rojas
(74) *Attorney, Agent, or Firm* — Cantor Colburn LLP

(57) ABSTRACT

The invention relates to an operating element (10) for a regulating and/or switching functionality having at least two switching or regulating stages, comprising:

an actuating part (4) which can be actuated manually and thereby moved out of a rest position; at least three permanent magnets (1, 2, 3), comprising:

a first movable permanent magnet (1), which is driven synchronously in its range of movement by the actuating part (4);

a second movable permanent magnet (2), which, in a first partial range of the range of movement of the first permanent magnet (1), is synchronously entrained by it through magnetic force, and whose further movement is inhibited in at least one second partial range of the range of movement of the first permanent magnet (1) by at least one stop (5*a*);

a third permanent magnet (3), which is stationary relative to the actuating part (4), for generating a magnetic return force on the at least first permanent magnet (1).

10 Claims, 3 Drawing Sheets

OPERATING ELEMENT HAVING TWO SWITCHING OR CONTROL STAGES

FIELD

The disclosure relates to an operating element for a regulating and/or switching function having at least two switching or regulating stages.

BACKGROUND

Operating elements that have at least two stages are known, for example, as double pressure pushbuttons, or are used, for example, as automatic transmission pre-selection levers. It is known to realize operating elements with several switching and/or regulating stages in the range of movement of the actuating part by means of components that are in mechanical engagement with one another, for example latching components. Such operating elements are subject to wear, so that the haptics and/or the position of the switching stages change as the wear increases.

In view of the drawbacks of the prior art, the disclosure provides an operating element with at least two switching stages which is low-wear and/or improved with regard to the haptic feedback.

SUMMARY

Benefit is achieved with an operating element according to claim 1. Advantageous embodiments are in each case the subject matter of the dependent claims. It must be remarked that the features cited individually in the patent claims can be combined in any technologically meaningful manner and thereby present other embodiments. The description, in particular in connection with the figures, additionally provides specificity for the disclosure.

The disclosure relates to an operating element for a regulating and/or switching functionality having at least two switching or regulating stages. The operating element includes an actuating part which can be actuated manually and moved out of at least one rest position. A movability of the actuating part in two, three or four directions or a free movability that is limited only by a stop can be provided. The disclosure is also not limited with regard to the type of actuating part and its mounting; for example, it is a pivotably mounted lever or a pushbutton.

The operating element includes at least three permanent magnets: a first movable permanent magnet, which is driven synchronously in its range of movement by the actuating part; a second movable permanent magnet, which, in a first partial range of the range of movement of the first permanent magnet, is synchronously entrained by it through magnetic force, and whose further movement is inhibited in at least one second partial range of the range of movement of the first permanent magnet by at least one stop, and a third permanent magnet, which is stationary relative to the actuating part, for generating a magnetic return force on the at least first permanent magnet.

Due to the magnetic interaction of the permanent magnets, a haptic feedback for the operator is achieved in an at least contact-free and thus low-wear manner. With regard to the detection of the movement of the operating part, the operating element is not limited. In a simple embodiment, the permanent magnets merely serve for generating a haptic feedback for the transition between the at least two switching and/or regulating stages, while the movement and/or position of the actuating part takes place in a different manner that is known to the person skilled in the art from technology.

In an exemplary embodiment, means for the detection of the movement and/or position of the first and second permanent magnet are provided in order to assign a switching or regulating functionality to the movement of the actuating part. This detection may be contact-free, for example by means of optical or magnetic sensors.

In order to generate a pronounced haptic action, the permanent magnets are disposed in such a way in the rest position that, in the case of the permanent magnets that are disposed closest to one another, respectively unlike poles of the permanent magnets are opposite to one another.

The first and second permanent magnets may be displaceably mounted parallel to their polar direction.

With regard to the dimensioning of the return force and the profile thereof, the disclosure is not limited. For example, one embodiment provides that, for generating a latching haptic action, the permanent magnets are configured and disposed in such a way that the return force has a local maximum in the first and second partial ranges of the range of movement of the first permanent magnet.

In another embodiment, an automatic return of the actuating part from all of its possible positions into the rest position is provided (monostable return).

The magnetically effected, in particular monostable, return of the actuating part or of the first permanent magnet can be realized with comparatively little effort and so as to save constructional space, if the first permanent magnet is disposed between the other permanent magnets, i.e. the first closest to the third permanent magnet.

Moreover, for example, the return force is selected in such a way in another embodiment that an automatic return of the first permanent magnet, and thus of the actuating part, into the at least one final position or end position and the rest position (bistable or polystable return), is provided.

It can be provided that the permanent magnets are provided exclusively for the return or the haptic feedback. Conventional mechanical sensors which detect the movement of the actuating part can be provided for the position detection of the actuating part.

However, means for the contact-free detection of the position of the first and/or second permanent magnets and an evaluation unit for generating a position-dependent signal are provided. Thus, the detection of the position can take place in a reliable and low-wear manner. For example, at least one optical sensor (light barrier or an optical encoder) or at least one magnetic sensor (Hall sensor or Reed sensor) is provided.

The operating element advantageously is used in a motor vehicle, for example as an automatic transmission pre-selection lever.

BRIEF DESCRIPTION OF THE FIGURES

The disclosure as well as the technical environment are explained below in more detail with reference to the figures. It must be remarked that the Figures depict a particular embodiment, but is not limited thereto. The Figures schematically show.

DETAILED DESCRIPTION

Figure 1:
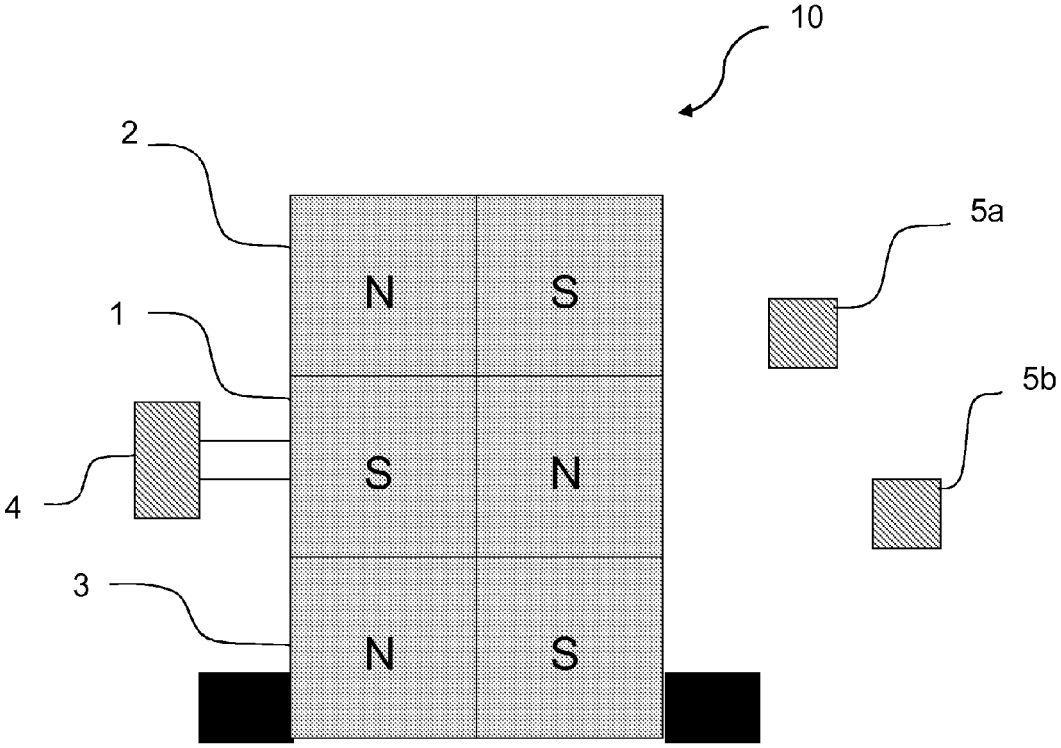
FIG. 1: the rest position of the actuating part 4 of the operating element 10, which is shown in an exemplary embodiment.
Figure 2:
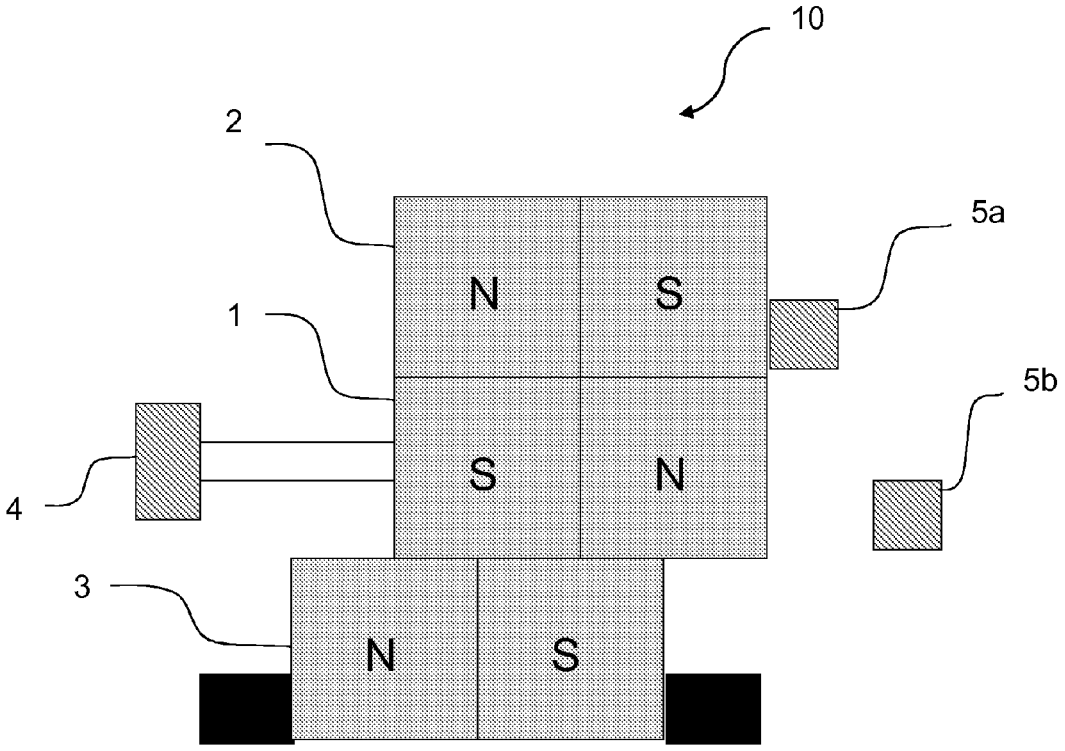
FIG. 2: the position of the actuating part 4 from FIG. 1 during the transition from the first to the second switching or regulating stage.
Figure 3:
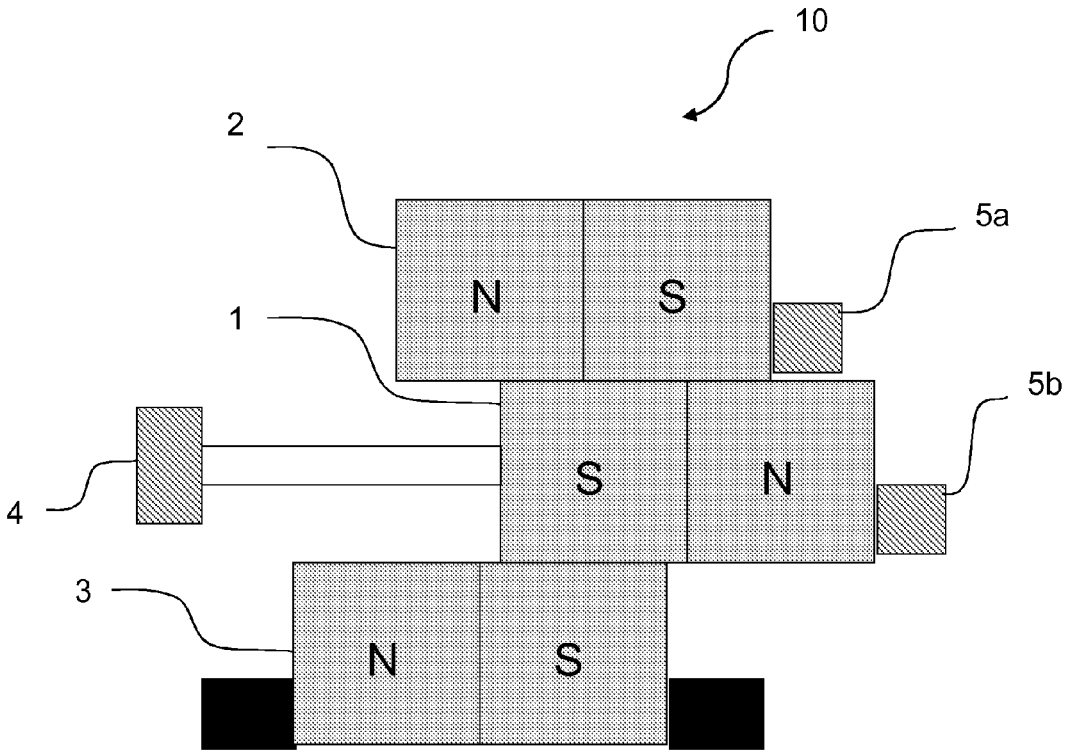
FIG. 3: the end position of the actuating part 4 from FIG. 1.

In a simplified schematic representation, the Figures show the mode of operation of the haptic feedback of the operating element 10. Three permanent magnets 1, 2, 3 are provided which, spaced from one another or adjacent to one another as shown, are disposed in such a way that unlike poles are adjacent to each other in the rest position of the operating element 10 shown in FIG. 1. The second and first permanent magnets 1, 2 are mounted so as to be movable parallel to their polar direction. The first permanent magnet 1 is disposed between the second and third permanent magnets 2, 3. The movement of the first permanent magnet 1 is caused by an actuating part 4 which cooperates with the permanent magnet 1 in such a way that a synchronous movement of the two takes place, in particular upon actuation of the actuating part 4. A return force of the first permanent magnet 1, and thus of the actuating part 4, which counteracts the manual actuation and urges the actuating part 4 back into the rest position shown in FIG. 1 is caused by the movement of the first permanent magnet 1 relative to the stationary permanent magnet 3. The special arrangement of the first and third permanent magnets 1, 3 causes a local maximum in the displacement-dependent profile of the return force (cogging), which can be haptically perceived on the actuating part 4 as a kind of catch. Due to the magnetic coupling, the first permanent magnet 1 entrains the second permanent magnet 2 until the latter comes to rest against its stop or travel limitation 5*a*, as is shown in FIG. 2. The stop 5*a* limits the range of movement of the second permanent magnet 2 to a smaller extent, compared with that of the first permanent magnet 1, so that, starting from here, the returning action of the third permanent magnet 3 on the first 1 is influenced in the further travel of the first permanent magnet 1 by the magnetic force due to the separation of the first 1 and the second permanent magnet. Also in this case, the special arrangement of the first and second permanent magnets 1, 2 causes a local maximum in the displacement-dependent profile of the return force (cogging), which can be haptically perceived on the actuating part 4 as a kind of catch in the kinetic transition to the transition in the end position shown in FIG. 3.

The invention claimed is:

1. An operating element for a regulating and/or switching functionality having at least two switching or regulating stages, comprising:

an actuating part which can be actuated manually and thereby moved out of a rest position; and at least three permanent magnets, comprising:

a first movable permanent magnet, which is driven synchronously over a range of movement by the actuating part;

a second movable permanent magnet, which, in a first partial range of the range of movement of the first permanent magnet, is synchronously entrained by the first permanent magnet through magnetic force, and whose further movement is inhibited in at least one second partial range of the range of movement of the first permanent magnet by at least one stop; and a third permanent magnet, which is stationary relative to the actuating part, for generating a magnetic return force on the at least first permanent magnet, wherein when the actuating part is in the rest position, unlike poles of the first permanent magnet, the second permanent magnet, and the third permanent magnet are positioned opposite one another, respectively.

2. The operating element according to claim 1, wherein the first and second permanent magnets are displaceably mounted parallel to their polar direction.

3. The operating element according to claim 1, wherein the permanent magnets are configured and disposed in such a way that the return force has one local maximum, respectively, in the first and second partial ranges of the range of movement of the first permanent magnet.

4. The operating element according to claim 1, wherein the actuating part can be moved out of the rest position in at least two directions.

5. The operating element according to claim 1, wherein the first permanent magnet is disposed between the other permanent magnets.

6. The operating element according to claim 1, wherein the permanent magnets are configured and disposed in such a way that two bistable end position, respectively, of the first and/or second permanent magnet are provided.

7. The operating element according to claim 1, comprising means for the contact-free detection of the position of the first and/or second permanent magnets and an evaluation unit.

8. The operating element according to claim 7, wherein the means for the contact-free detection comprise an optical and/or magnetic sensor.

9. A use of the operating element according to claim 1 in a motor vehicle, for example as an automatic transmission preselection lever.

10. An operating element for a regulating and/or switching functionality having at least two switching or regulating stages, comprising:

an actuating part which can be actuated manually and thereby moved out of a rest position in at least two directions; and at least three permanent magnets, comprising:

a first movable permanent magnet, which is driven synchronously over a range of movement by the actuating part;

a second movable permanent magnet, which, in a first partial range of the range of movement of the first permanent magnet, is synchronously entrained by the first permanent magnet through magnetic force, and whose further movement is inhibited in at least one second partial range of the range of movement of the first permanent magnet by at least one stop; and a third permanent magnet, which is stationary relative to the actuating part, for generating a magnetic return force on the at least first permanent magnet.

* * * * *